US005429400A

United States Patent [19]

Kawaguchi et al.

[11] Patent Number: 5,429,400

[45] Date of Patent: Jul. 4, 1995

[54] TRUNK LOCKING DEVICE

[75] Inventors: Kenzo Kawaguchi, Toyota; Hiroyuki Kyo, Okazaki; Hideaki Hukaya, Chita; Ichio Ikeda, Nagoya, all of Japan

[73] Assignee: Mitsubishi Jidosha Kogyo Kabushiki Kaisha, Tokyo, Japan

[21] Appl. No.: 245,889

[22] Filed: May 18, 1994

Related U.S. Application Data

[63] Continuation of Ser. No. 947,505, Sep. 17, 1992, abandoned.

[30] Foreign Application Priority Data

Sep. 17, 1991 [JP] Japan ..... 3-074454 U
Sep. 17, 1991 [JP] Japan ..... 3-074455 U
Sep. 17, 1991 [JP] Japan ..... 3-074462 U

[51] Int. Cl.[6] ..... E05C 3/02

[52] U.S. Cl. ..... 292/201; 292/341.16; 292/DIG. 25; 292/DIG. 43

[58] Field of Search ..... 292/201, 341.16, DIG. 25, 292/DIG. 43

[56] References Cited

U.S. PATENT DOCUMENTS

| | | | |
|---|---|---|---|
| 2,896,990 | 7/1959 | Garvey et al. | 292/341.16 |
| 2,903,288 | 9/1959 | Joachim et al. | 292/341.16 |
| 2,916,319 | 12/1959 | Du Bois | 292/341.16 |
| 2,994,550 | 8/1961 | White | 292/DIG. 43 X |
| 3,047,326 | 7/1962 | Leslie et al. | 292/DIG. 43 |
| 3,081,078 | 3/1963 | Lohr | 292/DIG. 43 X |
| 3,403,934 | 10/1968 | Butts | 292/341.16 |
| 3,572,065 | 3/1971 | Peters | 292/201 X |
| 3,835,678 | 9/1974 | Meyer et al. | 292/341.16 X |
| 4,707,007 | 11/1987 | Inoh | 292/341.18 X |
| 4,746,153 | 5/1988 | Compeau et al. | 292/DIG. 43 X |
| 4,823,059 | 4/1989 | Compeau et al. | 292/341.16 X |
| 4,968,073 | 11/1990 | Kuhlman | 292/201 |
| 4,976,478 | 12/1990 | Acciacca et al. | 292/341.16 X |
| 4,982,984 | 1/1991 | Yokota et al. | 292/341.16 X |
| 5,054,826 | 10/1991 | Dow et al. | 292/DIG. 43 X |
| 5,066,056 | 11/1991 | Schap | 292/341.16 |
| 5,158,330 | 10/1992 | Weyerstall et al. | 292/DIG. 43 X |

*Primary Examiner*—Lloyd A. Gall
*Attorney, Agent, or Firm*—Abelman, Frayne & Schwab

[57] ABSTRACT

When a trunk lid is pressed down, a latch and a striker engage to hold the lid in a position for closing the trunk opening, after which a control and a drive dislocate the striker downwards through a transmission, pulling the lid into a position to completely close the trunk opening and hold the lid in that position.

6 Claims, 17 Drawing Sheets

TRUNK LOCKING DEVICE

This application is a continuation of application Ser. No. 07/947,505, filed Sep. 17, 1992, now abandoned.

FIELD OF THE INVENTION

This invention relates to a trunk locking device for locking a trunk lid openably mounted to a vehicle.

BACKGROUND OF THE INVENTION

A sedan type vehicle is generally formed with a trunk (opening) at the rear of the vehicle to contain baggage, which has an openable lid, and can be locked by a locking device. FIG. 18 is a schematic view of a vehicle trunk provided with a prior art trunk locking device.

As shown in FIG. 18, a trunk 12 is formed at the rear of a vehicle body 11, which has an openable trunk lid 14 supported by a pair of hinges 13. The trunk lid 14 can be locked by a trunk locking device.

The prior art trunk locking device comprises a lock 101 mounted to the trunk lid 14 and a striker 102 mounted to the vehicle body 11. A rotatable latch (not shown) of the lock 101 engages with the striker 102 to bind the trunk lid 14 in a closed condition. On the other hand, binding between the latch and the striker 102 can be released by an opener lever 104 connected through a cable 103 to unlock the trunk lid 14.

In the above-described prior art trunk locking device, to close the trunk lid 14, the trunk lid 14 is pressed down from the opened condition shown in FIG. 18 to cause the latch to engage with the striker 102, thereby closing the trunk lid 14. However, the opening of the trunk 12 is peripherally provided with a rubber-made sealing member 15 in order to prevent baggage contained in the trunk 12 from wetting, and when the trunk lid 14 is closed, the trunk lid 14 must be pressed down against a repulsive force of the sealing member 15, which requires a fairly strong force and is tedious.

Furthermore, when the trunk lid 14 is closed with a strong force, a big closing noise is set up, causing an unpleasant feeling of passengers.

To eliminate such problems, there have heretofore been proposed various devices in which the latch and striker are engaged in the full-closing position of the trunk lid and, with the latch and striker engaged, the striker is moved down to achieve full closing of the trunk lid. This type of trunk locking devices include those which are disclosed in Japanese Utility Model Publication 63-6384/1988, Japanese Patent Publication Laid-open 61-183588/1986, and Japanese Patent Publication Laid-open 63-312484/1988.

However, such trunk locking devices form a single unit comprising a motor, a mechanism, and the striker, making the device large in size and requiring a large space, with less flexibility in mounting to the vehicle body.

Since, in this trunk locking device, the motor and the striker are directly connected, and the striker is moved solely by the motor, there has been a problem in that, if the motor malfunctions to become unoperatable when, for example, the trunk is open, that is, the striker is positioned in the upper position, the trunk lid becomes unclosable.

Furthermore, since, in this trunk locking device, the lid is fully closed by automatically moving the striker by the motor, there is a risk of the hand or the like being caught between the lid and the vehicle body when the lid is moved.

SUMMARY OF THE INVENTION

With a view to eliminate the prior art problems, it is a primary object of the present invention to provide a trunk locking device, which allows the trunk lid to be easily and positively closed with a small force and is flexible in mounting to the vehicle body, with improved safety.

In accordance with a present invention, there is provided a trunk locking device comprising a striker dislocatably disposed at the vehicle body side in the vicinity of an opening of a trunk provided at the rear of the vehicle body, a latch disposed at the lid side provided on the vehicle body and engageable with the striker for making the trunk opening openable, drive means, transmission means for transmitting a driving force of the drive means to the striker during operation of the drive means to dislocate the striker and allowing dislocation of the striker independent of the drive means at least during non-operation of the drive means, and control means for controlling the drive means so that the lid dislocates the striker in a direction for the lid to close the trunk opening.

Therefore, when the trunk lid is pressed down, the latch and the striker are engaged to bind the lid on this side of a position where the lid closes the trunk opening. When the latch and the striker are engaged, the control means controls the drive means, and the drive means dislocates the striker downward from the engaging condition through the transmission means, whereby the lid is pulled into a position to completely close the trunk opening, and held in position.

DETAILED DESCRIPTION OF THE INVENTION

Figure 1:
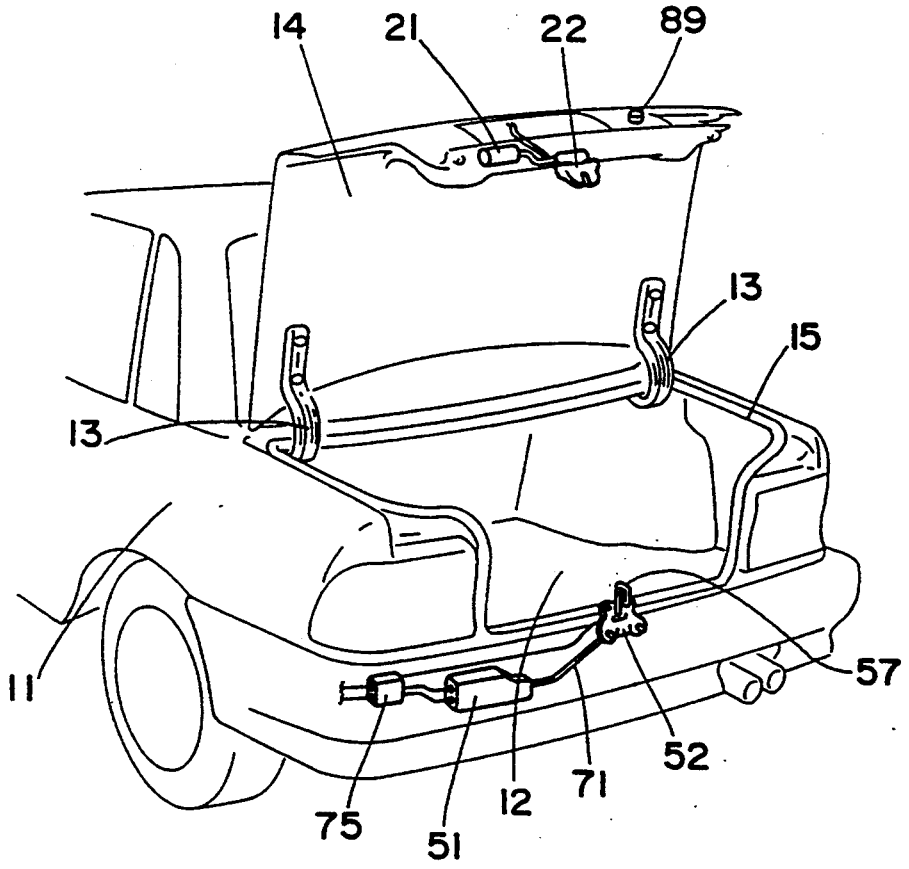
FIG. 1 is a schematic perspective view of a trunk of a vehicle provided with an embodiment of the trunk locking device according to the present invention.

An embodiment of the present invention will now be described in detail with reference to the drawings.

The trunk locking device of this embodiment comprises a trunk lock 22 mounted to a trunk lid 14 and having a release solenoid 21, and a striker 52 mounted to a vehicle body 11 and having a post moving drive unit 51. The trunk locking device can hold the trunk lid 14 at a first closing position on this side of a closing position and at a second closing position for complete closing. In this embodiment, the first closing position of the trunk lid 14 is a position where the trunk lid 14 lightly contacts the sealing member mounted to the trunk 12, and the second closing position of the trunk lid 14 is a position where the trunk lid 14 presses the sealing member 15 to achieve a close contact, thereby fully closing the trunk 12. Alternatively, however, the first closing position of the trunk lid 14 may be a non-contact position of the trunk lid 14 with the sealing member 15.

Figure 2:
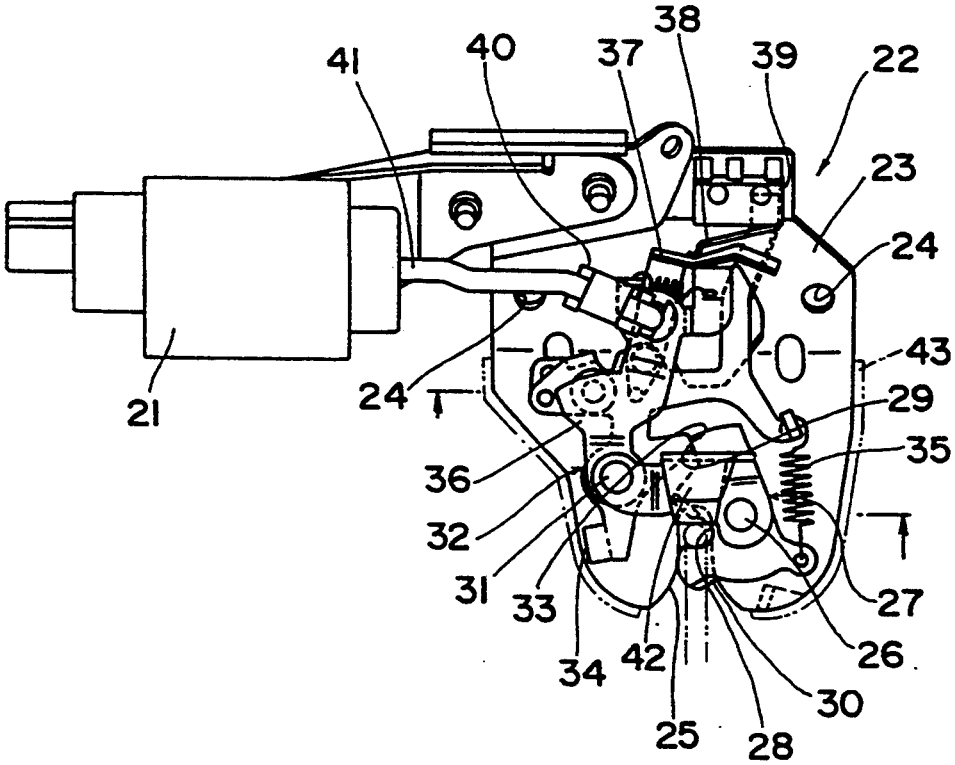
FIG. 2 is a schematic front view of a trunk lock.
Figure 3:
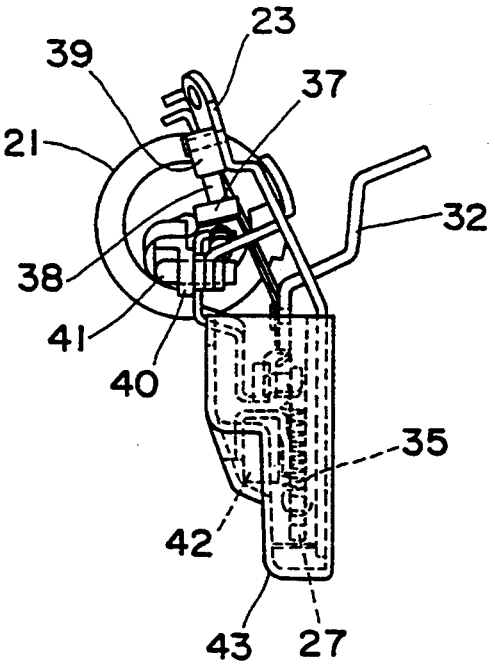
FIG. 3 is a schematic side view of a trunk lock.
Figure 4:
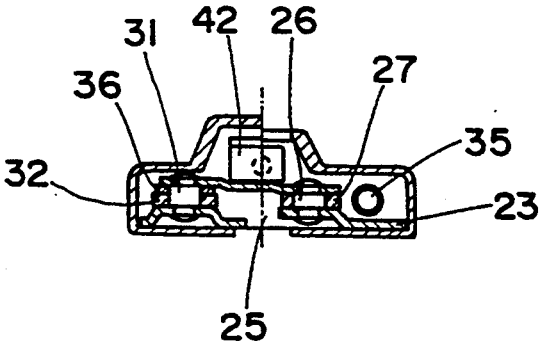
FIG. 4 is a schematic sectional view taken along line 4—4 in FIG. 2.

In the trunk lock 22, as shown in FIGS. 2 to 4, a base plate 23 is formed at both sides of its upper portion with mounting holes 24, and with an opening 25 into which a post 57 goes, which will be described later, at the center of the lower portion.

In the base plate 23, a latch 27 is supported by a shaft 26 at one side (right side in FIG. 2) of the opening 25, and the latch 27 is formed with an engaging portion 28 engaging with the post 57, an engaged portion 29 engaged by a pole 32, and a stopper 30. In addition, the pole 32 is supported by a shaft 31 at the other side (left side in FIG. 2) of the opening 25 of the base plate 23, and the pole 32 is formed with an engaging portion 33 for engaging the engaged portion 29 of the latch 27 and a stopper 34. A coil spring 35 is provided between the latch 27 and the pole 32 to urge the latch 27 in the counter-clockwise direction and the pole 32 in the clockwise direction, respectively, in FIG. 2.

Furthermore, the pole 32 is mounted with a switch lever 37 through a connecting plate 36 so as to rotate integrally with the pole 32. A motor actuation switch 39 having a switch piece 38 is mounted at the upper portion of the base plate 23, so that rotation of the switch lever 37 actuates the switch piece 38 to turn on and off the motor actuation switch 39. The connecting plate 36 is connected with one end of an actuation rod 41 of the release solenoid 21 by a holder 40, and the release solenoid 21 can be operated by an operation switch provided in the vicinity of the vehicle driver's seat. In FIGS. 2 to 4, numeral 42 indicates a rubber damper, and numeral 49 indicates a cover. A spring 36A is provided for positively moving the plate 36 in the clockwise direction.

Therefore, after the post 57 of the striker 52 goes into the opening 25 and engages with the engaging portion 28 of the latch 27, the latch 27 rotates against the urging force of the spring 95, and the engaged portion 29 contacts against the engaging portion 33 of the pole 32 to maintain the binding condition. On the other hand, when the solenoid 21 is energized to actuate the actuation rod 41 (to the left in FIG. 2) causing the pole 92 to rotate in the counter-clockwise direction in FIG. 2, the engaging portion 33 is released from the engaged portion 29 of the latch 27, and the latch 27 is rotated in the counter-clockwise direction by the urging force of the spring 35 to release the post 57 from binding.

In the striker 52, as shown in FIGS. 5 to 8, a base plate 53 is formed with mounting holes 54 to the vehicle body 11 on both sides at the upper and lower portions, and with a slot 55 vertically extending at the center. A slider 56 is mounted at its upper portion with a base end of the post 57 which has a square ring-formed side view (FIG. 6), and with an engaging pin 58 at the center. The engaging pin 58 is movably engaged with the slot 55 of the base plate 53, at both sides of the lower portion, sliding holes 59 extending vertically are formed at both sides of the lower portion, and the individual sliding hole 59 engages with a support pin 60 provided on the base plate 53.

Figure 5:
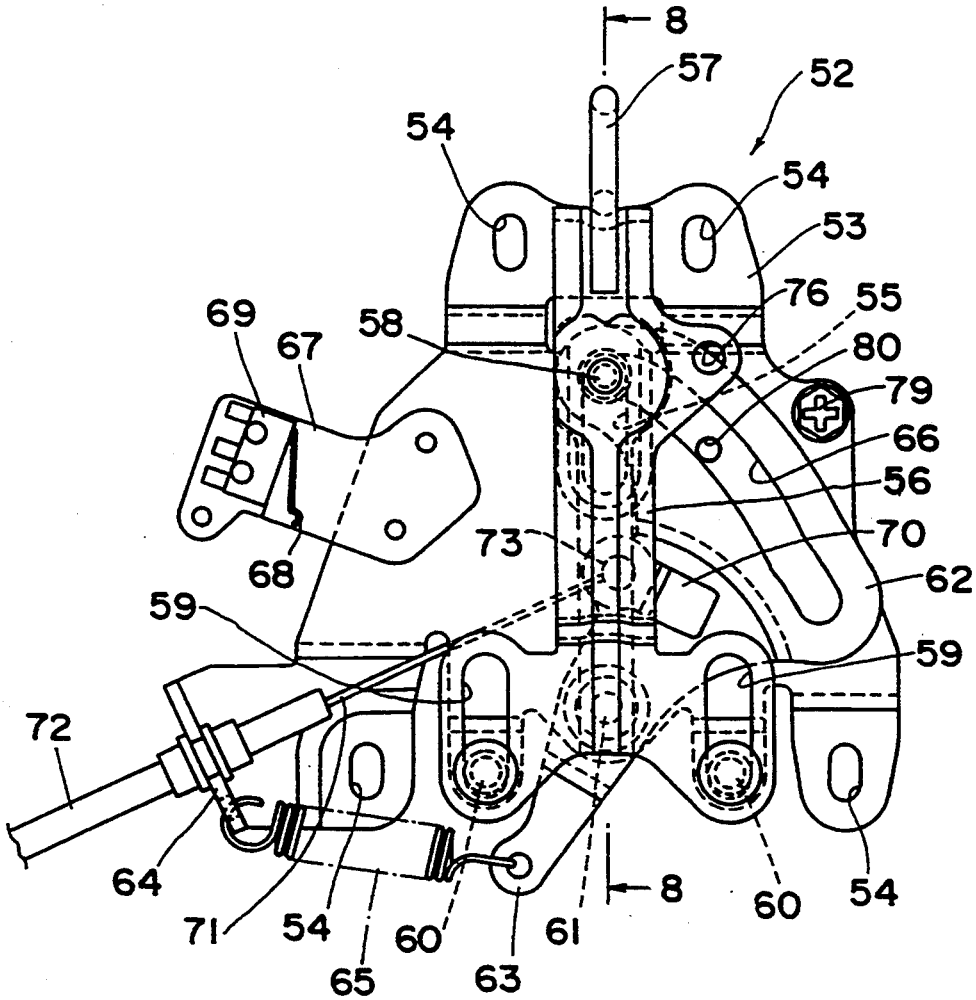
FIG. 5 is a schematic front view of a striker.
Figure 6:
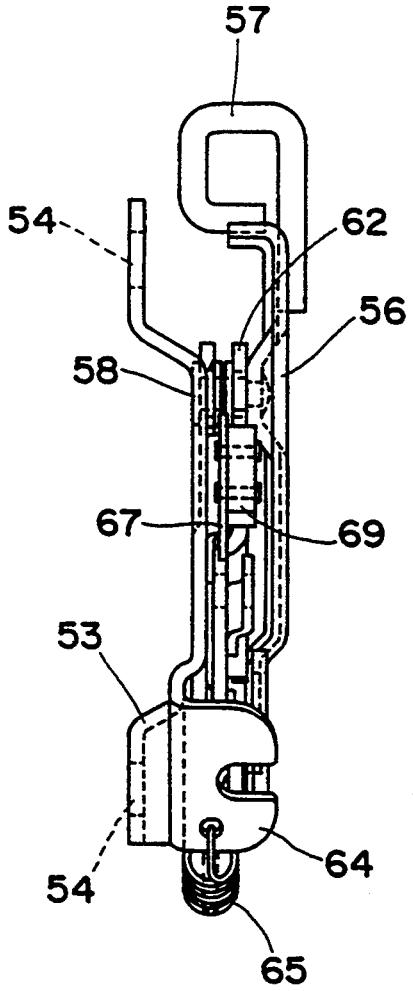
FIG. 6 is a schematic left side view of a striker.

The base plate 53 is rotatably mounted with a lever 62 by a supporting shaft 61, a coil spring 65 is provided between a projection 63 at the lower end and an upright wall 64 of the base plate 53, and the lever 62 is urged in the clockwise direction in FIG. 5 by the spring 65. The lever 62 is formed with an arc-formed cam groove 66, and the engaging pin 58 mounted to the slider 56 penetrates through the cam groove 66.

Furthermore, the base plate 53 is mounted with a motor stopping switch 69 having a switch piece 68 through a bracket 67. Turning the lever 62 actuates the switch piece 68 to turn on and off the motor stopping switch 69. The lever 62 is mounted with a connecting piece 70, a case 72 of a drive cable 71 of the drive unit 51 is supported on the upright wall 64 of the base plate 53, and the top end of the drive cable 71 is connected to the connecting piece 70 through a connecting pin 73.

Therefore, when the drive cable 71 is pulled by the drive unit 51, the lever 62 rotates in the counter-clockwise direction in FIG. 5 against the urging force of the spring 65 and, due to the cam groove 66 of the lever 62, the engaging pin 58 moves along the slot 55 of the base plate 53 (downward in FIG. 5). Then, the post 57 also moves through the slider 56 mounted with the engaging pin 58. When the lever rotates in a predetermined amount to turn off the motor stopping switch 69, the drive unit 51 is stopped, and the post 57 is maintained at a downward-moved position.

On the other hand, when the drive unit 51 is driven in reverse to stop pulling the drive cable 71, the lever 62 is rotated in the clockwise direction in FIG. 5 by the urging force of the spring 65 and, due to the cam groove 66, the engaging pin 58 moves along the slot 55 (upward in FIG. 5). As a result, the post 57 also moves through the slider 56 mounted with the engaging pin 58 to the original position.

The drive unit 51 incorporates a motor, a reducer, and a winding drum for winding the drive cable 71, which are not shown here, and is connected with a relay box 75 as shown in FIG. 1.

Figure 7:
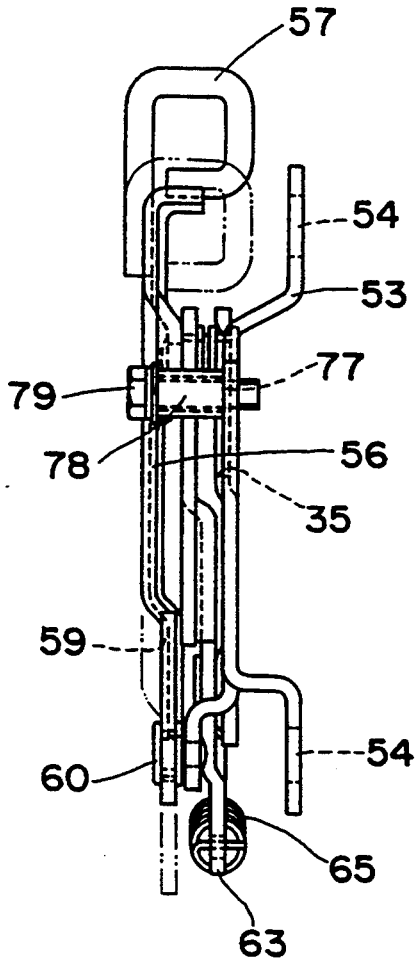
FIG. 7 is a schematic right side view of a striker.
Figure 8:
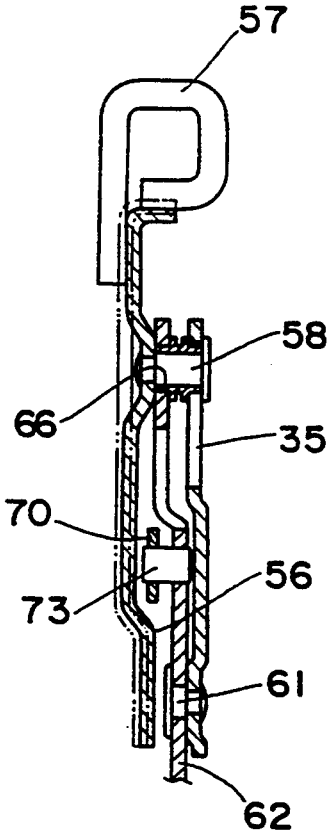
FIG. 8 is a schematic sectional view taken along line 8—8 in FIG. 5.
Figure 9:
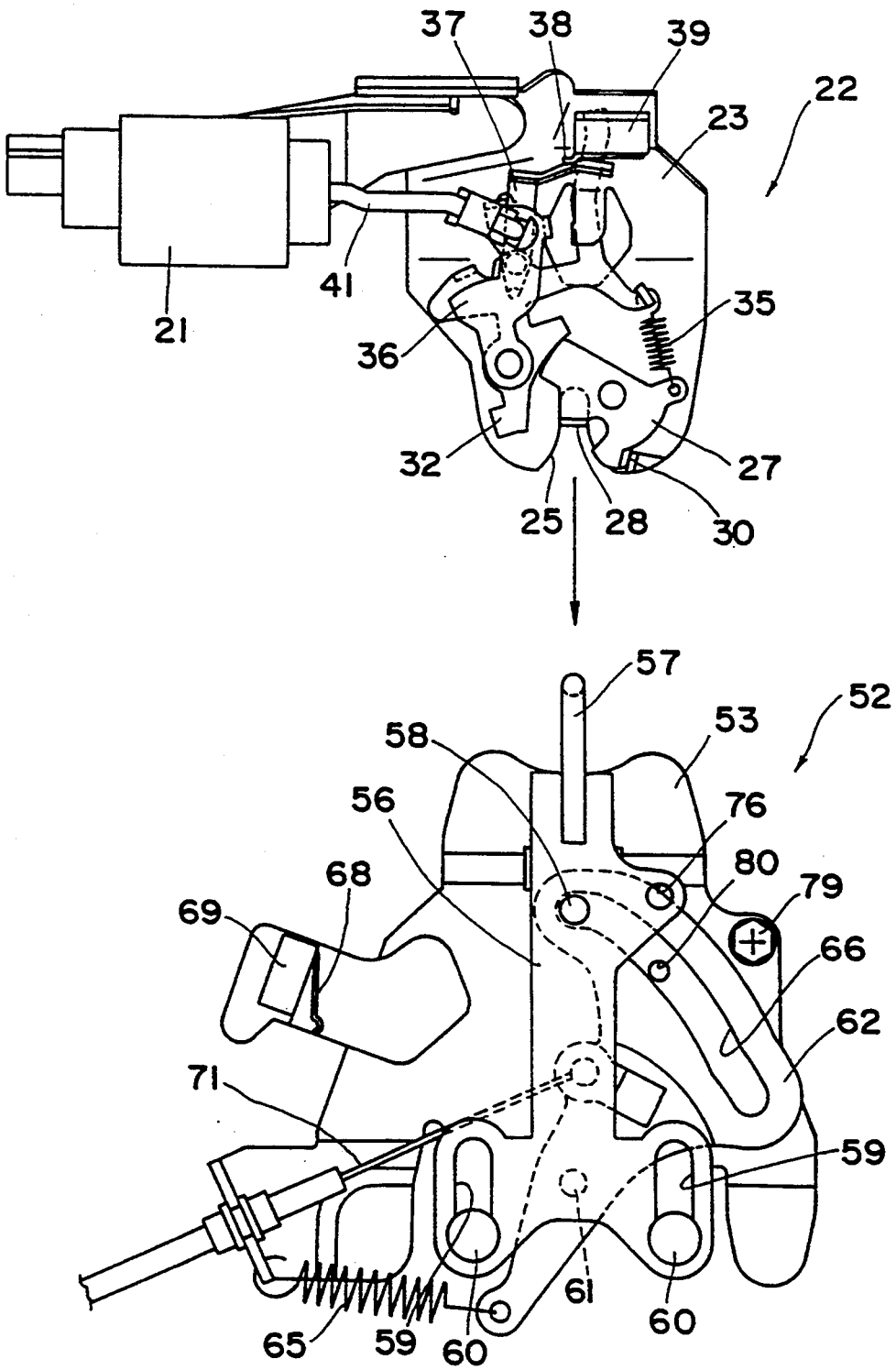
FIGS. 9 to 14 are schematic views showing operation condition of the trunk locking device.

The trunk locking device of this embodiment is provided with a striker holding device as protective means which enables manual locking for a case where the drive unit 51 malfunctions. As shown in FIG. 5 and FIG. 7, the slider 56 to which the post 57 is mounted is formed at its right end with a through hole 76. The base plate 53 of the striker 52 is formed at its right end with a spare screw hole 77, and a mounting bolt 79 as a mounting member is detachably screwed in the spare screw hole 77 through a supporting cylinder 78. Furthermore, the base plate 53 is formed with a screw hole 80 which can be screwed with the mounting bolt 79 at a position in line with the through hole 76 when the slider 56 moves down.

Therefore, with the slider 56 moved down, by screwing the mounting bolt 79 with the screw hole 80 through the through hole 76 of the slider 56, the slider 56 (post 57) can be held at a lower position (second closing position of the trunk lid 14 corresponding to the full closing condition).

Furthermore, the trunk locking device of this embodiment is provided with a safety device to prevent the hand or the like from being caught between the trunk lid 14 and the vehicle body 11. The safety device will now be described with reference to the operation circuit diagram shown in FIG. 15.

Figure 15:
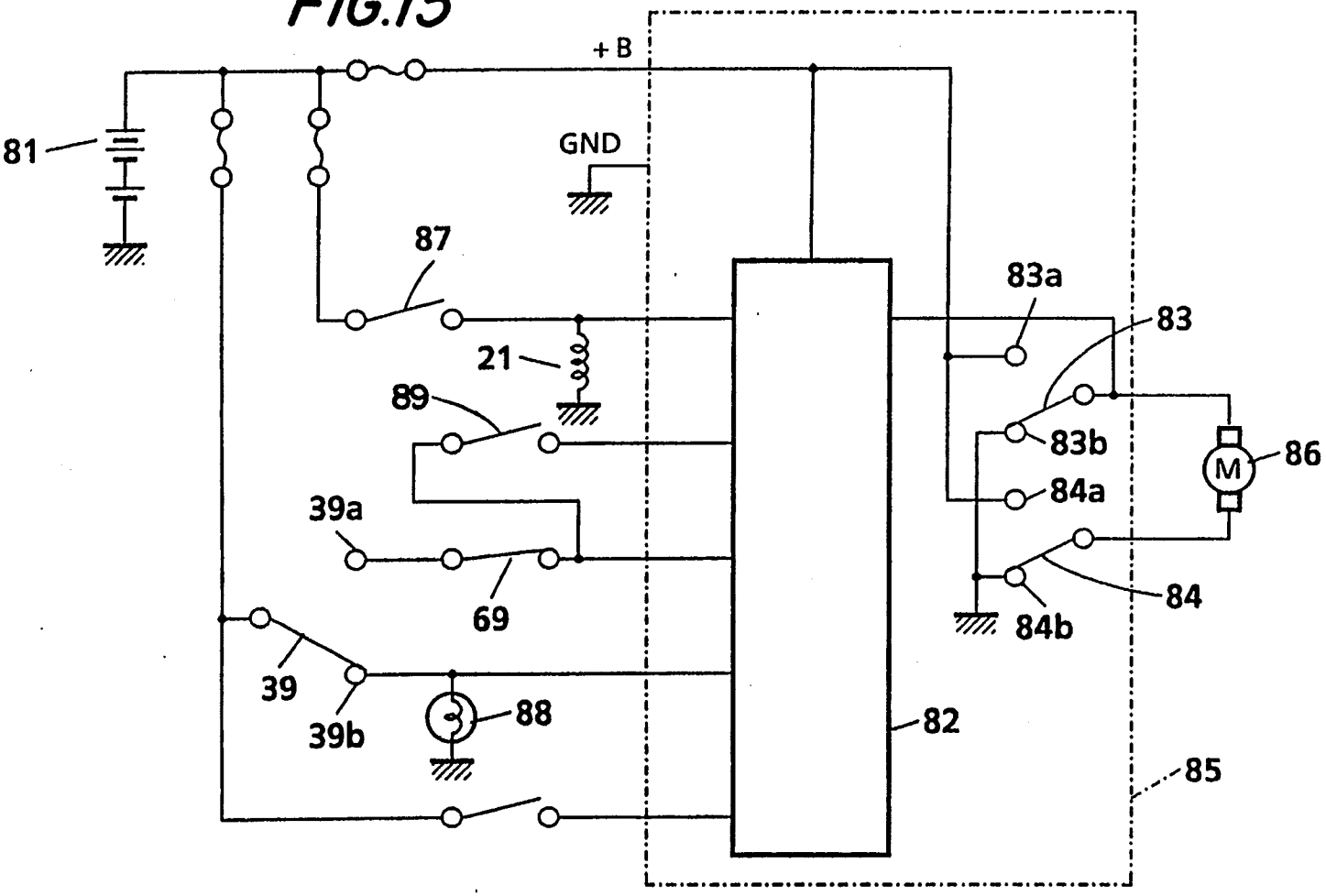
FIG. 15 is an operation circuit diagram of the trunk locking device.

As shown in FIG. 15, a battery 81 provided on the vehicle is connected with a control circuit 82 and a control unit 85 having motor select switches 83 and 84, and further with a motor 86 of the drive unit. A lid opener switch 87 is connected between the battery 81 and the control circuit 82 and, at the control unit side, to one end of the releasing solenoid 21, with the other end grounded. The motor actuation switch 39 is connected to the battery 81 and has two contacts 39*a* and 39*b*. One contact 39*a* is connected to the control circuit 82 through the motor stopping switch 69, and the other contact 39*b* is grounded through a trunk room lamp 88 and connected to the control circuit 82 directly. Furthermore, as shown in FIG. 1, an emergency stop switch 89 as the safety device provided at the rear of the vehicle body 11 is connected between the motor stopping switch 69 and the control circuit 82. The motor 86 of the drive unit 51 has two select switches 83 and 84, and individually have two contacts 83*a* and 83*b* and contacts 84*a* and 84*b*.

Next, operation of the trunk locking device according to the present invention will now be described with reference to FIGS. 9 to 13. In order to clarify operation positions of the individual components, those which are not related here are omitted in the individual Figures.

First, closing the trunk lid 14 will be described. As shown in FIG. 1, with the trunk lid 14 opened, the lock 22 and the striker 52 of the trunk locking device are in the condition shown in FIG. 9. That is, in the lock 22, the engaging portion 28 of the latch 27 faces downward, and the switch lever 37 of the pole 32 presses the switch piece 38 of the motor actuation switch 39 to set it off. The post 57 (slider 56) of the striker 52 is located at the upper portion (first closing position in this embodiment). At this moment, the operation circuit is in a condition shown in FIG. 15.

Figure 10:
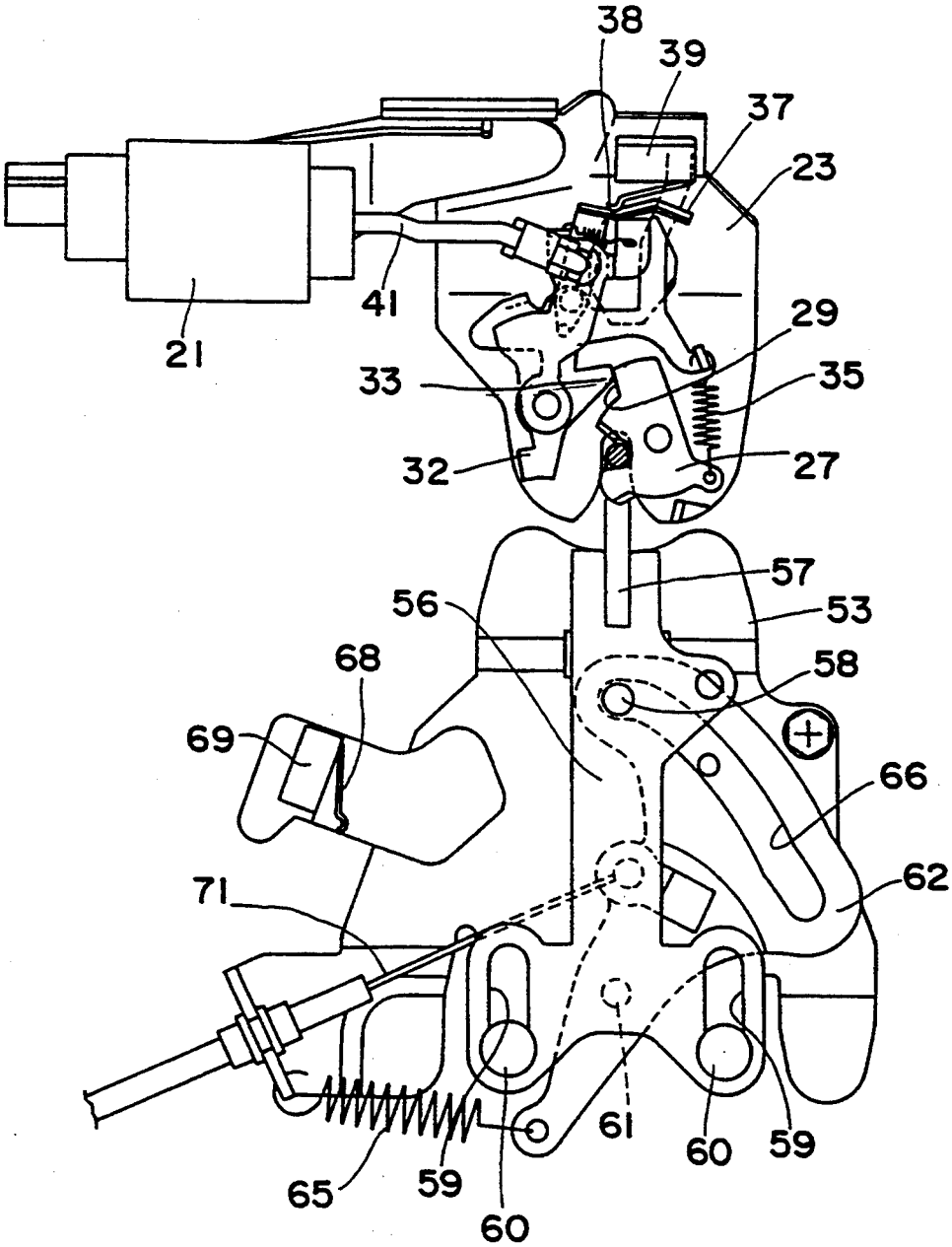

From this condition, when the trunk lid 14 is pressed down to close it, the lock 22 first moves down and, as shown in FIG. 10, the post 57 of the striker 52 goes into the opening 25 of the base plate 23. The post 57 engages with the engaging portion 28 of the latch 27 to rotate the latch 27 against the urging force of the spring 35. Then the engaged portion 29 of the latch 27 is engaged with the engaging portion 33 of the pole 32 to suppress counter-clockwise rotation of the latch 27, and the post 57 is held in a bound condition by the latch 27. At this moment, the trunk lid 14 is held at the first closing position on this side of the fully closing position, and is in light contact with the sealing member 15 provided in the periphery of the trunk 12. Therefore, the operator can reduce engaging noise of the latch 27 with the striker 52 (post 57) without receiving a large sealing repulsive force.

When the pole 32 is rotated by the rotation of the latch 27, the switch lever 37 also rotates to stop pressing the switch piece 38, turning on the motor actuation switch 39 from the contact 39*a* to the contact 39*b*. Then, in the drive unit 51 for the striker 52, with the select switch 84 at the contact 84*b*, the select switch 83 is changed over from the contact 83*b* to the contact 83*a*, and the motor 86 operates in the forward direction. The drive unit 51 pulls the drive cable 71 to rotate the lever 62 in the counter-clockwise direction against the urging force of the spring 65, moving down the engaging pin 58 along the slot 55 due to the cam groove 66. Then, the post 57 also moves downward through the slider 56 to which the engaging pin 58 is mounted. As a result, the trunk lid 14 moves down along with the latch 27 bound with the post 57, that is, along with the lock 22.

Figure 11:
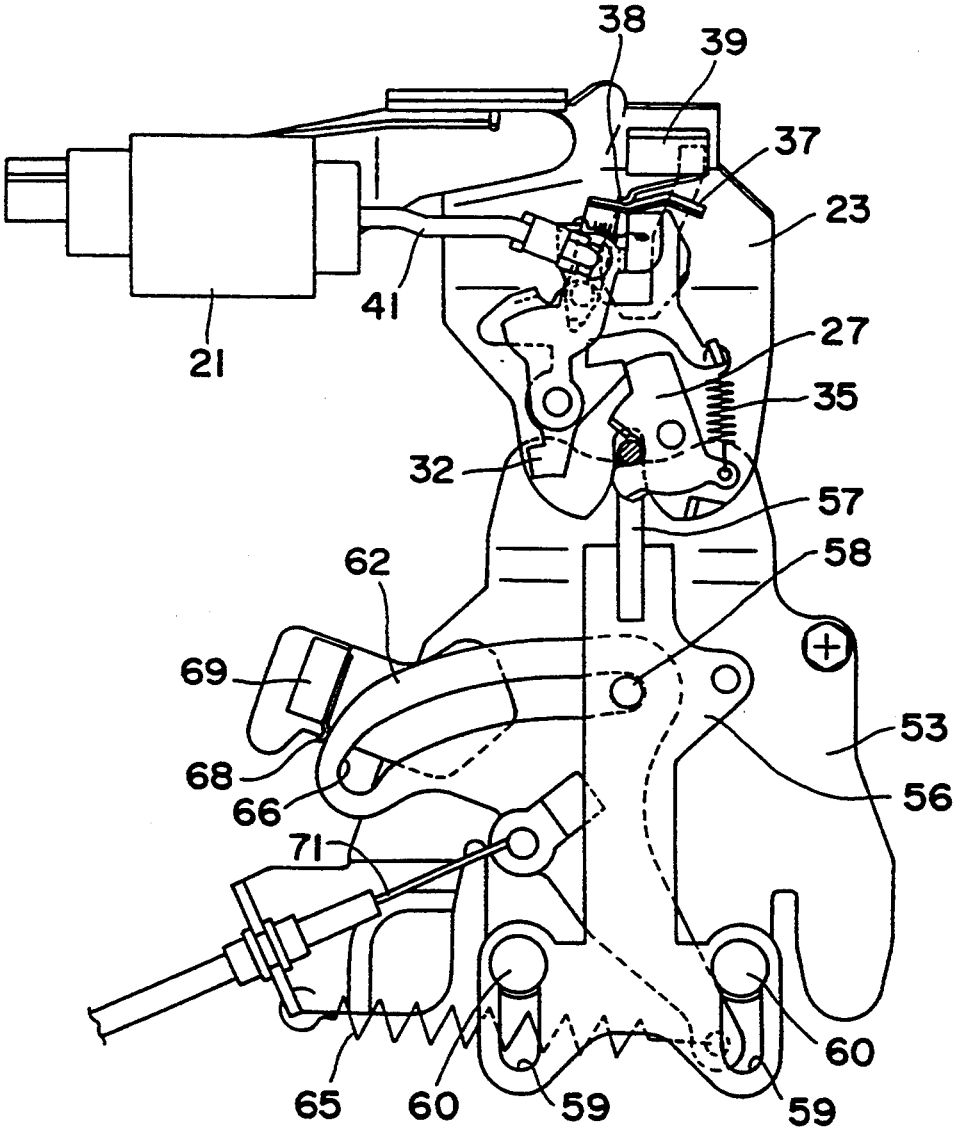
Figure 12:
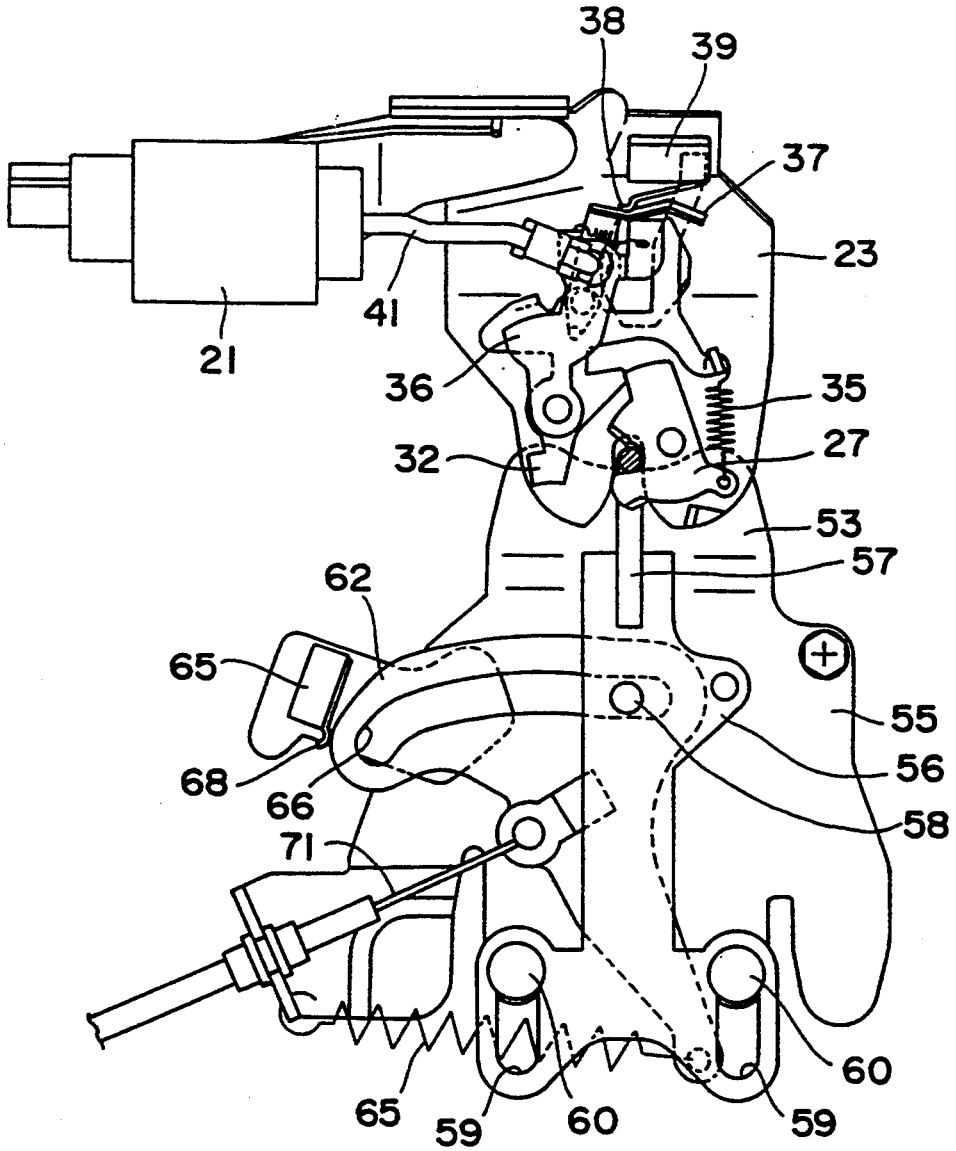

When the lever 62 rotates in a predetermined amount to the position shown in FIG. 11, its end portion presses the switch piece 68 of the motor stopping switch 69 to turn it off, stopping the motor 86 of the drive unit 51. When the drive unit 51 is stopped to release the drive cable 71 from pulling, as shown in FIG. 12, the level 62 slightly reverts back and is held at the position as shown. At this moment, since the level 62 is held at this position, the engaging pin 58 is positioned in the lower position due to the cam groove 66, in turn, the lock 22 is held in position through the slider 56, the post 57, the latch 27 and the like, and the trunk lid 14 is held at the second closing position where the lid fully closes the trunk 12.

As described above, since the trunk lid 14 is pressed down to cause the latch 27 and the post 57 to engage when the trunk lid 14 lightly contacts the sealing member 15 of the vehicle body 11 side, binding the lock 22 (trunk lid 14) to the striker 52 (vehicle body 11), the trunk lid 14 can be closed with a small force. When the latch 27 engages with the post 57, the post 57 can be moved downward to achieve complete closing of the trunk lid 14.

Figure 13:
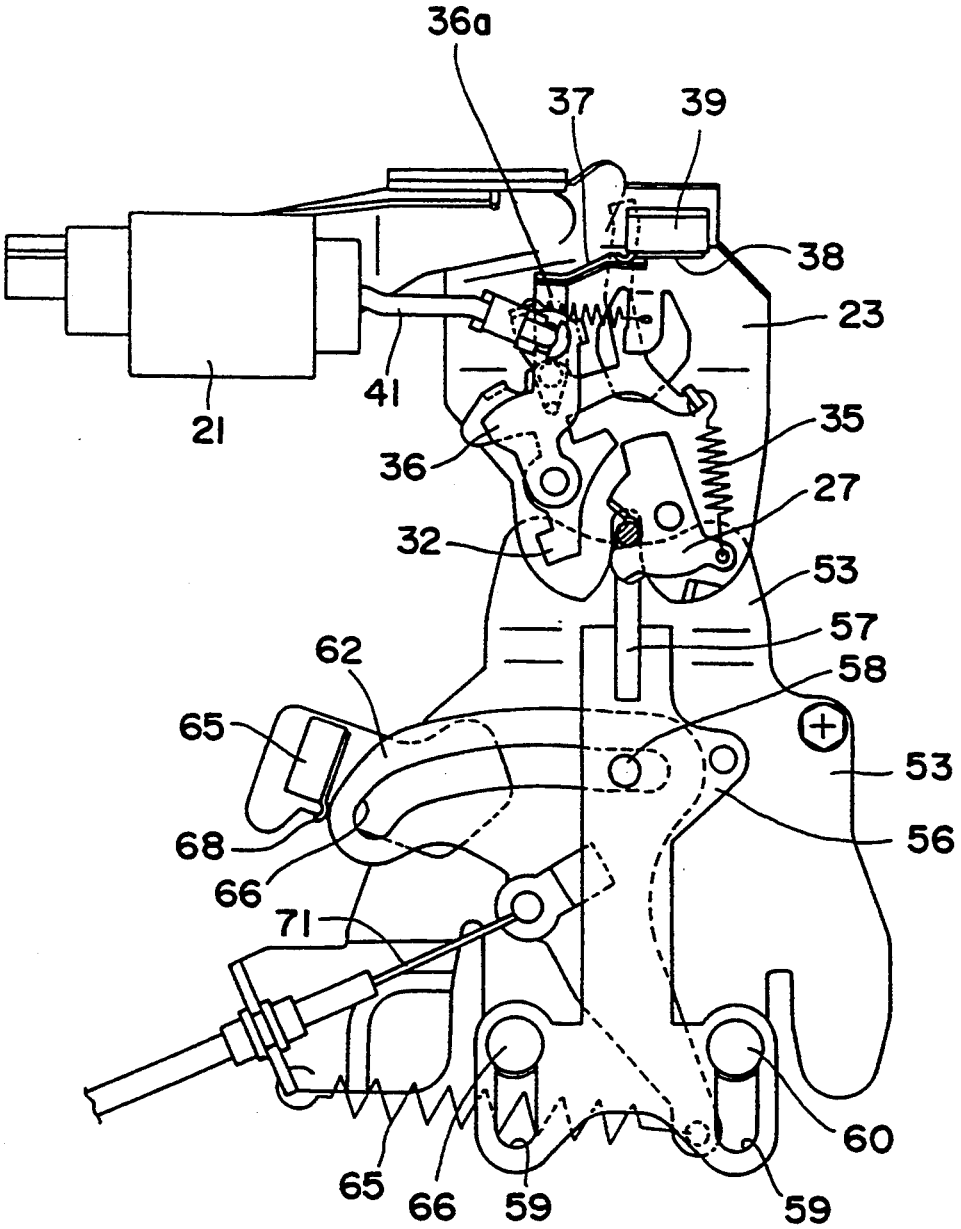

Next, opening the trunk lid 14 will now be described. From the full closing condition (second closing position) of the trunk lid 14 as shown in FIG. 12, when the solenoid 21 is energized by operating the lid opener switch 87 in the vicinity of the driver's seat to move the actuation rod 41 to the left as shown in FIG. 13, the pole 32 rotates counter-clockwise in FIG. 13, the engaging portion 33 is released from the engaged portion 29 of the latch 27, and the latch 27 rotates counter-clockwise in the Figure by the urging force of the spring 35 to release the post 57. As a result, engagement between the lock 22 and the striker 52 is released, and the trunk lid 14 becomes openable.

When the pole 32 rotates in the counter-clockwise direction, the switch lever 37 presses the switch piece 38 of the motor actuation switch 39 to change over the contact from 39*a* to 39*b*. This causes, at the drive side of the striker, the contact of the select switch 84 to change over from 84*b* to 84*a*, and the contact of the select switch 83 to change over from 83*a* to 83*b*, rotating the motor 86 in the reverse direction. When the drive cable 71 is released, the lever 62 rotates clockwise in FIG. 13 due to the urging force of the spring 65, and the engaging pin 58 moves upward along the slot due to the cam groove 66. As a result, the post 57 released from engagement with the latch 27 moves upward to the original position (that is, the first closing position in this embodiment).

In the above-described trunk closing operation, if the hand or the like is caught between the trunk lid 14 and the vehicle body 11, the safety device can be operated to prevent the danger.

Specifically, the contact of the motor actuation switch 39 is at 39*a* in the closing operation of the trunk lid 14, and when the hand or the like is caught between the trunk lid 14 and the vehicle body 11, the emergency stop switch 89 is operated (pressed). As a result, a high potential of the battery is applied to the control circuit 82 through the contact 39*a* of the motor actuation switch 39, the motor stopping switch 59, and the emergency stop switch 89, and operation of the emergency switch 89 is detected. At this moment, as shown in FIG. 15, the control circuit 82 energizes the releasing solenoid 21 and, as shown in FIG. 13, the pole 32 rotates and its latch 27 releases the post 57. This releases engagement between the lock 22 and the striker 52 to open the trunk lid 14, thereby preventing the hand or the like from being caught between the trunk lid 14 and the vehicle body 11.

In the above-described embodiment, the emergency stop switch 89 of a pushbutton switch type is provided as a safety device at the rear of the vehicle body 11, however, the trunk locking device according to the present invention is not limited to this type. For example, the emergency stop switch may alternatively be turned on and off by turning a key cylinder lid of the trunk lock, that is, any type may be used which can be quickly operated when the hand or the like is caught between the trunk lid 14 and the vehicle body 11.

Prevention of danger by a safety device is not limited to releasing the trunk lock 22 but, for example, the contact of the select switch 89 and 84 may be changed over by the emergency switch 89 (while the trunk lid 14 is moving down) to stop or reverse the motor 86.

Figure 14:
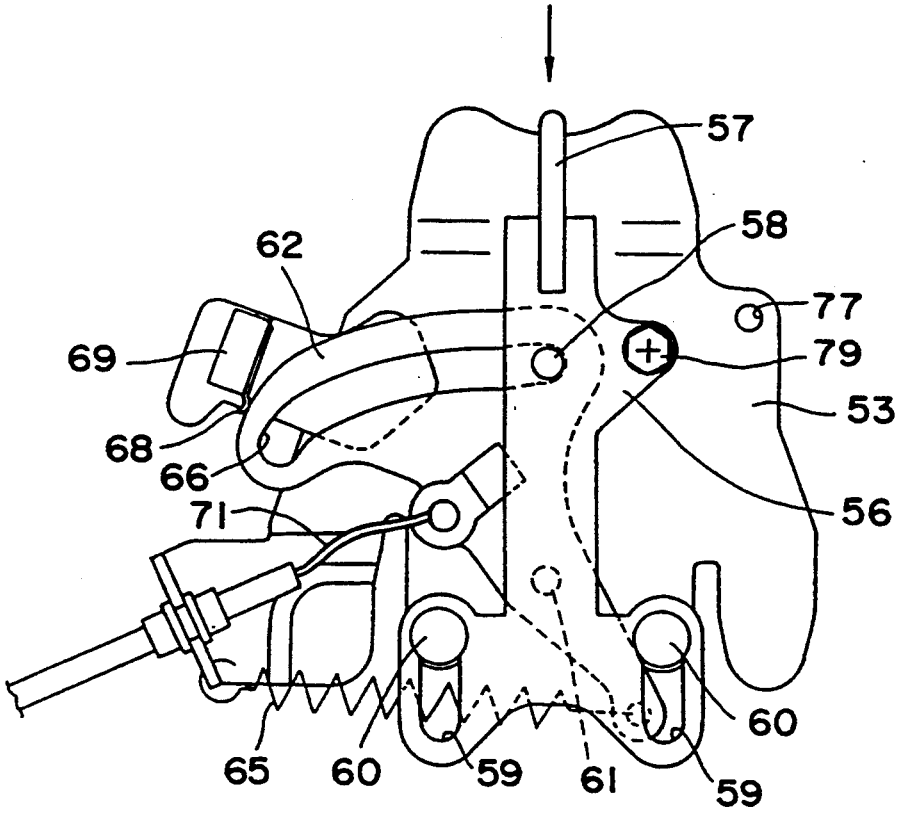

Here, a case where the drive unit 51 malfunctions with the trunk lid 14 opened (FIG. 1) and the post 57 of the striker 52 positioned at the upper position (the first closing position in this embodiment) (FIG. 9) will now be described. In this case, the driver removes a trim (not shown) and the like, the mounting bolt 79 is loosened from the spare screw hole 77, and the mounting bolt 79 and the supporting cylinder 78 are removed. Then, as shown in FIG. 14, the post 57 (slider 56) is pressed down to a lower position by hand, in this condition, the mounting bolt 79 is penetrated through the through hole 76 of the slider 56 and the supporting cylinder 78 to be screwed into the screw hole 80 of the base plate 53. Thus, the slider 56 is fixed in this position (the second closing position in this embodiment), and the post 57 is also held at the lower position.

In this case, when the slider 56 is moved down, the lever 62 turns to press the drive cable 71, making an extra length of the drive cable 71. This extra length of the drive cable 71 can be absorbed at the striker side by slacking a portion exposed from the case 72, or by slacking at the winding drum side in the drive unit 51.

From this condition, when the trunk lid 14 is closed, as in the prior art trunk locking device, the latch 27 and the post 57 are engaged causing the striker 52 to bind the lock 22, the trunk lid 14 is held at the second closing position and thus closed.

As the striker holding device to be used when the drive unit 51 malfunctions, in the above-described embodiment, the slider 56 is held by the mounting bolt 79 at the second closing position corresponding to the full closing position of the trunk lid 14. However, the trunk locking device according to the present invention is not limited to this.

Figure 16:
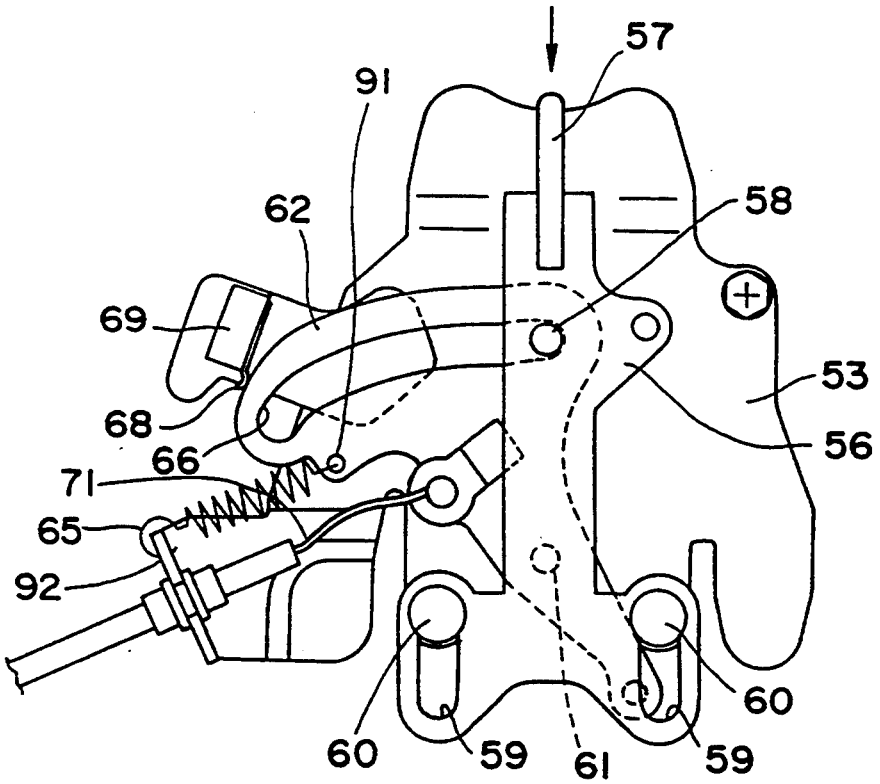
FIG. 16 and FIG. 17 are individually a schematic front view and a schematic side view showing another holding means of the trunk locking device according to the present invention.
Figure 17:
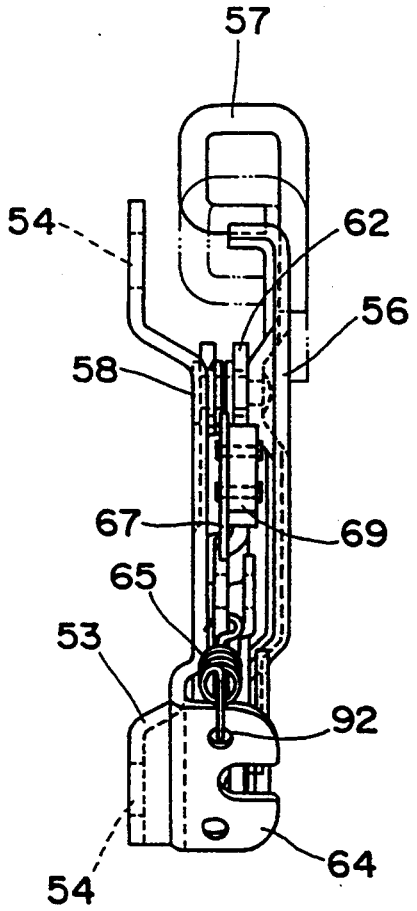
Figure 18:
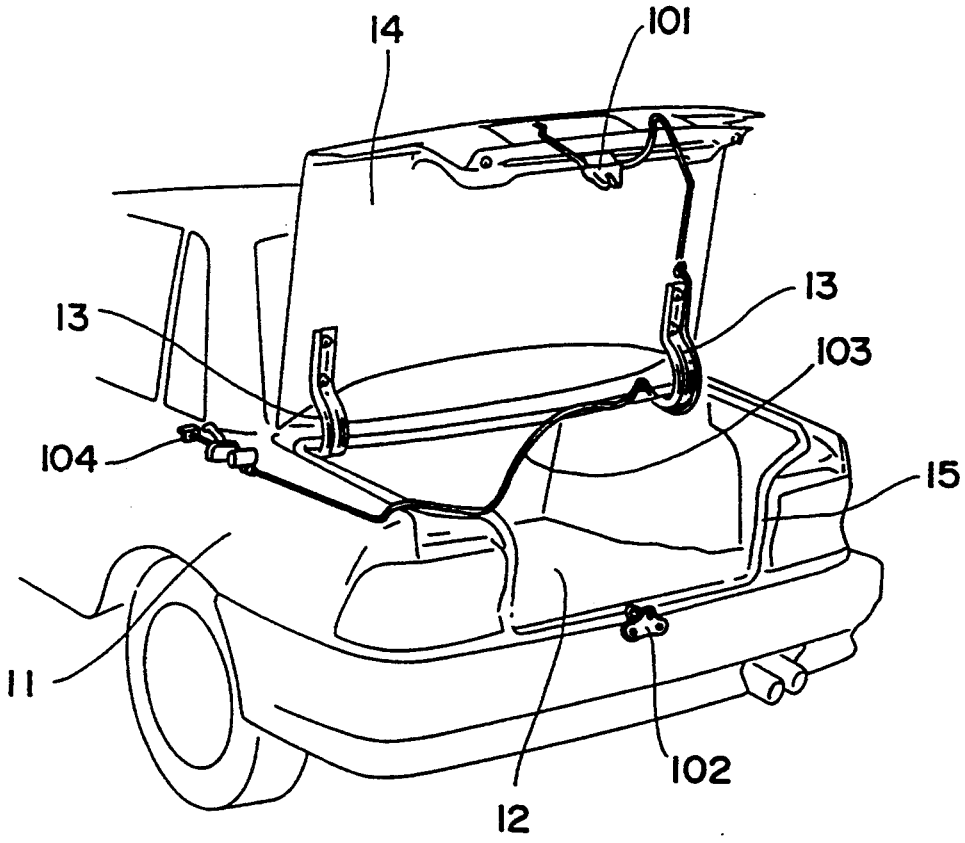
FIG. 18 (PRIOR ART)
FIG. 18 is a schematic view of a vehicle trunk provided with a prior art trunk locking device.

For example, as shown in FIGS. 16 and 17, a mounting hole is previously formed in the lever 62, and a mounting hole 92 is formed in the upright wall 64 of the base plate 53. The spring 65 disposed between the projection 63 of the lever 62 and the upright wall 64 is replaced to between the mounting hole 91 of the lever 62 and the mounting hole 92 of the upright hole 64.

Therefore, the slider 56 (post 57), which was held at the upper position corresponding to the first closing position through the cam groove 66 and the engaging pin 58 because the lever 62 is urged by the spring 65 in the clockwise direction in FIG. 16, is bound at the lower position corresponding to the second closing position through the cam groove 66 and the engaging pin 58 because the lever 62 is urged in the counterclockwise direction in FIG. 16 by the replaced spring 65.

As described above in detail with reference to the embodiment, with the trunk locking device according to the present invention, since the striker is dislocatably provided at the vehicle body side, the latch is provided engageable with the striker at the lid side to make the trunk opening openable, when the drive means operates, the driving force is transmitted through the transmission means to dislocate the striker and, when the drive means is not in operation, the striker can be dislocated independent of the drive means, and the drive means is controlled so that when the latch is engaged with the striker by the control means, the striker is dislocated in a direction so as the lid to close the trunk opening, the trunk lid is bound to the vehicle body by engaging the latch with the striker when the trunk lid lightly contacts the sealing member at the vehicle body side and, from this condition, the striker moves down to achieve complete closing of the trunk lid. Therefore, the trunk lid can be closed with a small force without receiving a large repulsive force due to the sealing member, with reduced closing noise of the trunk lid due to a buffering effect of the sealing member, preventing the passengers from unpleasant feeling.

Furthermore, since the striker and the drive means are connected by a cable as transmission means, the portion disposed at the trunk opening (striker) can be made compact, with improved flexibility in installation to the vehicle body.

Moreover, a fixing member is provided to fix the striker at a position where the lid fully closes the trunk opening, whereby the trunk lock can be positively closed even if the drive means malfunctions.

Since the control means has switch means, when an emergency condition is detected, for example, when the hand or the like is caught between the trunk lid and the vehicle body, the switch means can be operated to release the latch or to stop or reverse dislocation of the striker, thereby preventing such a danger, with improved safety.

We claim:

1. A trunk locking device comprising:

a striker mechanism dislocatably disposed at a vehicle body in the vicinity of an opening of a trunk;

a latch disposed at a trunk lid provided on the vehicle body and engageable with said striker mechanism for closing said trunk lid;

a drive means;

a transmission means for transmitting a driving force of said drive means to said striker mechanism to dislocate a post of said striker mechanism and allowing such dislocation also during non-operation of said drive means; and a control means for controlling said drive means;

said striker mechanism being movable into an extended position in which said latch is engageable with said post and said trunk opening is not completely closed, and into a retracted position in which said trunk opening is completely closed, further, comprising said striker mechanism including locking means by which said striker mechanism is held in said retracted position independently of operation of said drive means;

said transmission means having a wire connecting said drive means and said striker mechanism; and, said striker mechanism comprising a slider dislocatable between the retracted and the extended positions, to which said post is fixed, and a pivotable lever connected to said slider via a guide, such that a pivoting movement of said lever results in a dislocational movement of the slider, and, that the lever is coupled to said transmission means; in which said lever is biased by means of a spring such that said slider is pushed into the extended position and is pivotable by said drive means against the spring force via said transmission means such that said slider is movable into the retracted position, and said lever and a vehicle body side base plate are provided with holding members for holding said spring, said spring biasing said slider during normal operation in said extended position being insertable into said holding members; said locking means comprising said spring being selectively mounted in additional holding members to lock said striker mechanism in the retracted position.

2. The trunk locking device of claim 1, in which said locking means comprise a bolt to fix said striker mechanism to said vehicle body.

3. The trunk locking device of claim 1, in which said control means comprises a switch means and an output signal of said switch means is received for a predetermined period of time from the time said latch is engaged with said striker mechanism.

4. The trunk locking device of claim 1, further including a switch means for controlling said drive means to stop or reverse the dislocation of said striker mechanism.

5. The truck locking device of claim 4, in which said latch comprises an engagement release means for releasing engagement between said latch itself and said striker mechanism, and, when said switch means operates, said engagement release means being controlled to release engagement between said latch and said striker mechanism.

6. The trunk locking device of claim 5, in which said switch means is provided at said trunk lid.

* * * * *

UNITED STATES PATENT AND TRADEMARK OFFICE

CERTIFICATE OF CORRECTION

PATENT NO. : 5,429,400
DATED : July 4, 1995
INVENTOR(S) : Kawaguchi, et. al.

It is certified that error appears in the above-indentified patent and that said Letters Patent is hereby corrected as shown below:

Title page, item [73], Assignee: should read as followings:
-- Mitsubishi Jidosha Kogyo Kabushiki Kaisha, Tokyo, JAPAN, --
-- and, ANSEI CORPORATION, Aichi, JAPAN Signed and Sealed this
Seventh Day of May, 1996

Bruce Lehman

*Attest:*

BRUCE LEHMAN

*Attesting Officer*

*Commissioner of Patents and Trademarks*